US007375718B2

(12) United States Patent
Kim

(10) Patent No.: US 7,375,718 B2
(45) Date of Patent: May 20, 2008

(54) GATE DRIVING METHOD AND APPARATUS FOR LIQUID CRYSTAL DISPLAY PANEL

(75) Inventor: Sang Rae Kim, Pohang-shi (KR)

(73) Assignee: LG. Philips LCD. Co., Ltd., Seoul (KR)

( * ) Notice: Subject to any disclaimer, the term of this patent is extended or adjusted under 35 U.S.C. 154(b) by 706 days.

(21) Appl. No.: 10/874,615

(22) Filed: Jun. 23, 2004

(65) Prior Publication Data

US 2004/0263452 A1 Dec. 30, 2004

(30) Foreign Application Priority Data

Jun. 24, 2003 (KR) ..... 2003-41116

(51) Int. Cl.
*G09G 3/36* (2006.01)

(52) U.S. Cl. ..... 345/100; 345/84; 345/87; 345/102

(58) Field of Classification Search ..... 345/100, 345/84, 87, 102
See application file for complete search history.

(56) References Cited

U.S. PATENT DOCUMENTS 6,621,547 B2 * 9/2003 Kang ..... 349/151
6,639,589 B1 * 10/2003 Kim et al. ..... 345/206

* cited by examiner

*Primary Examiner*—Richard Hjerpe
*Assistant Examiner*—Leonid Shapiro
(74) *Attorney, Agent, or Firm*—Brinks Hofer Gilson & Lione

(57) ABSTRACT

A gate driving method and apparatus for a liquid crystal display panel is disclosed that minimizes deterioration of picture quality caused by a variation in a gate low voltage. A liquid crystal cell matrix is defined by intersections between gate lines and data lines having corresponding thin film transistors. A gate driver applies a gate high voltage, which is at least equal to the turn-on voltages of the thin film transistors, to the gate lines in a corresponding period, and applies an independent gate low voltage to the gate lines divided into a plurality of blocks as turn-off voltages of the thin film transistors in each block.

25 Claims, 10 Drawing Sheets

GATE DRIVING METHOD AND APPARATUS FOR LIQUID CRYSTAL DISPLAY PANEL

This application claims the benefit of the Korean Patent Application No. P2003-41116 filed in Korea on Jun. 24, 2003, which is hereby incorporated by reference.

BACKGROUND OF THE INVENTION

1. Field of the Invention

This invention relates to a liquid crystal display, and more particularly to a gate driving method and apparatus for a liquid crystal display panel that minimizes deterioration of picture quality caused by a variation in a gate low voltage.

2. Description of the Related Art

Generally, a liquid crystal display (LCD) controls light transmittance of a liquid crystal having a dielectric anisotropy using an electric field to thereby display a picture. To this end, the LCD includes a liquid crystal display panel for displaying a picture, and a driving circuit for driving the liquid crystal display panel.

In the liquid crystal display panel, liquid crystal cells arranged in a matrix type control the light transmittance in accordance with pixel signals to thereby display a picture.

The driving circuit includes a gate driver for driving gate lines of the liquid crystal display panel, a data driver for driving the data lines, a timing controller for controlling the driving timing of the gate driver and the data driver, and a power supply for supplying power signals required for driving the liquid crystal display panel and the driving circuit.

The data driver and the gate driver are separated into a plurality of drive integrated circuits (IC's). Each of the integrated drive IC's is mounted in an opened IC area of a tape carrier package (TCP) or in a base film of the TCP by a chip on film (COF) system, to thereby be connected to the liquid crystal display panel by a tape automated bonding (TAB) system. Alternatively, the drive IC may be directly mounted onto the liquid crystal display panel by a chip on glass (COG) system. The timing controller and the power supply are mounted onto a main printed circuit board (PCB).

The drive IC's connected to the liquid crystal display panel by the TAB system are connected, via the TCP, a sub-PCB (i.e., a gate PCB and a data PCB) and a flexible printed circuit (PCB), to the timing controller and the power supply on the main PCB.

The drive IC's mounted onto the liquid crystal display panel by the COG system are connected, via line on glass (LOG) type signal lines provided at the FPC and the liquid crystal display panel, to the timing controller and the power supply on the main PCB.

Recently, when the drive IC's are connected, via the TCP, to the liquid crystal display panel, the LCD adopts LOG-type signal lines to reduce the number of PCB's, thereby having a thinner thickness. Particularly, the gate PCB delivering a relatively small number of signals is removed, and a plurality of signal lines for applying gate control signals and power signals to the gate drive IC's are provided on the liquid crystal display panel in a LOG type. Thus, the gate drive IC's mounted in the TCP receives the control signals from the timing controller and the power signals from the power supply by way of the main PCB, FPC, the data PCB, the data TCP, the LOG-type signal lines and the gate TCP in turn. In this case, since the gate control signals and the gate power signals applied to the gate drive IC's are distorted by line resistances of the LOG-type signal lines, deterioration in the picture quality displayed on the liquid crystal display panel becomes a problem.

More specifically, as shown in FIG. 1, a LOG-type LCD removed with the gate PCB includes a data PCB 16, a data TCP 12 mounted with a data driving IC 14 and connected between the data PCB 16 and a liquid crystal display panel 6, and a gate TCP 8 mounted with a gate driving IC 10 and connected to the liquid crystal display panel 6.

In the liquid crystal display panel 6, a thin film transistor array substrate 2 and a color filter array substrate 4 are joined to each other with having a liquid crystal therebetween. Such a liquid crystal display panel 6 includes liquid crystal cells defined at intersections between gate lines GL and data lines DL, each of which has a thin film transistor as a switching device. The thin film transistor applies a pixel signals from the data line DL to the liquid crystal cell in response to a scanning signal from the gate line GL.

The data drive IC 14 is connected, via the data TCP 12 and a data pad of the liquid crystal display panel, to the data line DL. The data drive IC 14 converts a digital pixel data into an analog pixel signal to apply it to the data line DL. To this end, the data drive IC 14 receives a data control signal and a pixel data from a timing controller (not shown) and a power signal from a power supply (not shown) by way of the data PCB 16.

The gate drive IC 10 is connected, via the gate TCP 8 and a gate pad of the liquid crystal display panel 6, to the gate line GL. The gate drive IC 10 sequentially applies a scanning signal having a gate high voltage VGH to the gate lines GL. Further, the gate drive IC 10 applies a gate low voltage VGL to the gate lines GL in the remaining interval excluding the time interval when the gate high voltage VGH has been supplied.

To this end, the gate control signals from the timing controller and the power signals from the power supply are applied, via the data PCB 16, to the data TCP 12. The gate control signals and the power signals applied via the data TCP 12 are applied, via a LOG-type signal line group 20 provided at the edge area of the thin film transistor array substrate 2, to the gate TCP 8. The gate control signals and the power signals applied to the gate TCP 8 are inputted, via input terminals of the gate drive IC 10, within the gate drive IC 10. Further, the gate control signals and the power signals are outputted via output terminals of the gate drive IC 10, and applied, via the gate TCP 8 and the LOG-type signal line group 20, to the gate drive IC 10 mounted in the next gate TCP 8.

The LOG-type signal line group 20 is typically comprised of signal lines for supplying direct current driving voltages from the power supply, such as a gate low voltage VGL, a gate high voltage VGH, a common voltage VCOM, a ground voltage GND and a base driving voltage VCC, and gate control signals from the timing controller, such as a gate start pulse GSP, a gate shift clock signal GSC and a gate enable signal GOE.

Such a LOG-type signal line group 20 is formed from the same gate metal layer as the gate lines at a specific pad area of the thin film transistor array substrate 2 in a fine pattern. Thus, the LOG-type signal line group 20 has a larger line resistance than the signal lines on the existent gate PCB. This line resistance distorts gate control signals (i.e., GSP, GSC and GOE) and power signals (i.e., VGH, VGL, VCC, GND and VCOM), thereby causing deterioration in the picture quality such as a horizontal line (i.e., gate dim) 32, cross talk in the dot pattern or a greenish tinge to the color, etc.

FIG. 2 is a view for explaining the horizontal line phenomenon caused by the LOG-type signal line group 20.

Referring to FIG. 2, the LOG-type signal line group 20 is comprised of a first LOG-type signal line group LOG1 connected to an input terminal of a first gate TCP 8, a second LOG-type signal line group LOG2 connected to an input terminal of a second gate TCP 9, and a third LOG-type signal line group LOG3 connected to an input terminal of a third gate TCP 13. The first to third LOG-type signal line groups LOG1 to LOG3 have line resistances aΩ, bΩ and cΩ proportional to the line length thereof, respectively, and are connected, via the gate TCP's 8, 9 and 13, to each other in series.

Thus, the first gate drive IC 10 is supplied with gate control signals GSP, GSC and GOE and power signals VGH, VGL, VCC, GND and VCOM voltage-dropped by the line resistance aΩ of the first LOG-type signal line group LOG1; the second gate drive IC 11 is supplied with those voltage-dropped by the line resistances aΩ+bΩ of the first and second LOG-type signal line groups LOG1 and LOG2; and the third gate drive IC 15 is supplied with those voltage-dropped by the line resistances aΩ+bΩ+cΩ of the first to third LOG-type signal line groups LOG1 to LOG3.

Accordingly, a voltage difference is generated among gate signals VG1 to VG3 applied to the gate lines of first to third horizontal blocks A to C driven with different gate drive IC's 10, 11 and 15, thereby causing horizontal lines 32 among the first to third horizontal line blocks A to C.

FIG. 3 shows a gate signal waveform applied to a plurality of gate lines GLi to GLi+3 included in the liquid crystal display panel 2 shown in FIG. 1.

Each of the gate lines GLi to GLi+3 is maintained at a gate low voltage VGL except for a horizontal period Hi when each gate line is supplied with a gate high voltage VGH upon arriving at a sequence to be scanned. Because a gate insulating film exists at the intersection of the gate line GLi and the data line DL a parasitic capacitor is formed. However, the parasitic capacitor causes instability as the gate low voltage VGL supplied to the gate line GLi is swung in response to a pixel signal applied to the data line DL.

For instance, the gate low voltage VGL is alternately swung toward a positive polarity and a negative polarity every horizontal period in accordance with an average value of pixel signals applied to one horizontal line while alternating a positive polarity and a negative polarity, as shown in FIG. 3, in response to a dot inversion system. Such a swing phenomenon of the gate low voltage VGL is generated similarly at other gate lines to which the gate low voltage VGL is commonly applied via the gate drive IC and the LOG-type signal lines. In this case, a swing width of the gate low voltage is enlarged due to a load amount applied to the gate low voltage VGL, that is, a large parasitic capacitor (i.e., a parasitic capacitor between the gate line and the data line) and a large line resistor of the LOG-type signal line. Such an unstable gate low voltage VGL varies the pixel voltage via a storage capacitor Cst provided between the pixel electrode and the pre-stage gate line. As a result, when a specific dot pattern is displayed by a dot inversion system, a greenish tinge in which a green (G) pixel having a polarity contrary to adjacent red (R) and blue (B) pixels is observed at a relatively large brightness is generated thereby causing deterioration of the picture quality. Furthermore, when a window pattern is displayed using a dot inversion system, horizontal cross talk in which a peripheral area adjacent to the window pattern in a horizontal direction is observed during generation of a relatively large brightness causes deterioration in the picture quality.

SUMMARY OF THE INVENTION

Accordingly, the present invention provides a gate driving method and apparatus for a liquid crystal display panel that minimizes deterioration of the picture quality caused by a variation in a gate low voltage.

In addition, a gate driving method and apparatus is presented that minimizes deterioration of the picture quality caused by a variation in a resistance component of an LOG-type signal line.

In different embodiments, a liquid crystal display panel has a liquid crystal cell matrix and a gate driver. The liquid crystal cell matrix is defined by intersections between gate lines and data lines and contains thin film transistors. The gate driver applies a gate high voltage, which is a turn-on voltage of the thin film transistors, to the gate lines in a time period and applies an independent gate low voltage to the gate lines divided into a plurality of blocks as a turn-off voltage of the thin film transistor for each block.

The liquid crystal cell matrix may be divided into an upper block and a lower block, and the gate driver applies a first gate low voltage to the gate lines at the upper block and a second gate low voltage to the gate lines at the lower block.

The gate driving apparatus may further include a swing voltage attenuator for inverting and amplifying the first gate low voltage fed-back through the gate driver and summing the inverted and amplified first gate low voltage with the second gate low voltage fed-back through the gate driver, thereby canceling out swing voltages of the first and second gate low voltages with respect to each other.

The gate driving apparatus may further include a power source for generating the gate high voltage and for generating the gate low voltage to supply the gate low voltage via first and second transmission lines connected, in parallel, to an output line thereof as the first and second gate low voltages, respectively.

Additionally, the first and second gate low voltages may be set to the same level.

The first and second gate low voltages also may be applied, via different line on glass (LOG) type signal lines provided at the liquid crystal display panel, to the gate driver.

Each of the liquid crystal cells may further include a storage capacitor provided at an overlapping portion between a pixel electrode included therein and a pre-stage gate line.

A gate driving method for a liquid crystal display panel, having a liquid crystal cell matrix defined by intersections between gate lines divided into a plurality of blocks and data lines and transistors at the intersections, according to another aspect of the present invention includes applying a gate high voltage equaling or exceeding the turn-on voltage of the transistors to the gate lines in a time period and applying independent gate low voltages to the gate lines as a turn-off voltage of the transistors in each block.

In the gate driving method, the liquid crystal cell matrix may be divided into an upper block and a lower block. In this case, a first gate low voltage may be applied to the gate lines at the upper block and a second gate low voltage may be applied to the gate lines at the lower block.

The gate driving method may further include inverting and amplifying the first gate low voltage fed-back from the liquid crystal display panel and summing the inverted and amplified first gate low voltage with the second gate low voltage fed-back from the liquid crystal display panel, thereby canceling out swing voltages of the first and second gate low voltages with respect to each other.

The gate driving method may further include generating the gate high voltage and generating the gate low voltage to supply the gate low voltage via first and second transmission lines connected in parallel as the first and second gate low voltages, respectively.

As above, the first and second gate low voltages may be set to the same level.

The first and second gate low voltages may be applied via different line on glass (LOG) type signal lines provided at the liquid crystal display panel.

In another aspect, the liquid crystal display contains a gate driver that supplies a gate high voltage to the gate lines throughout the matrix. The gate driver also supplies a gate low voltage to the gate lines of each block that are independent of the gate low voltage supplied to the gate lines of other blocks. Each transistor is in a non-conducting state upon application of the gate low voltage and being in a conducting state upon application of the gate high voltage. As the gate high voltages are being supplied to the gate lines in a scan throughout the matrix, only one transition occurs between application of the gate high voltage to the gate lines in one block and application of the gate high voltage to the gate lines in another block.

The gate driver may comprise a plurality of gate drive ICs that each drive a set of gate lines in one of the blocks. In this case, at least one of the gate drive ICs drives the gate lines of only one of the blocks and at least one of the gate drive ICs drives the gate lines of different blocks.

Each gate drive IC may comprise a shift register and a level shifter array containing a level shifter for each gate line connected with the gate drive IC. In this case, half of the level shifters in the level shifter array of one of the gate drive ICs may supply a first gate low voltage to the gate lines connected with the half of the level shifters and the other half of the level shifters supply a second gate low voltage that is independent of the first gate low voltage to the gate lines connected with the other half of the level shifters. The level shifters in the gate drive IC that supply the first and second gate low voltages to the gate lines may also supply the same gate high voltage to each of the gate lines connected with the gate drive IC that supplies the first and second gate low voltages and/or the level shifters in the gate drive ICs other than the gate drive IC that supplies the first and second gate low voltages to the gate lines may supply the same gate low voltage to each of the gate lines connected with the particular gate drive IC. In the latter case, the gate low voltages supplied to all of the gate lines may be the same.

The gate high voltages may be sequentially supplied to the transistors throughout the matrix.

The liquid crystal display panel may further comprise a swing voltage attenuator through which one of the gate low voltages fed-back through the gate driver is inverted and amplified and then summed with another of the gate low voltages fed-back through the gate driver.

The different gate low voltages may be supplied to the gate driver via different line on glass (LOG) type signal lines. In this case, the different LOG type signal lines may have substantially the same path length on the substrate and/or a first of the blocks may be supplied solely with a first gate low voltage, a second of the blocks supplied solely with a second gate low voltage, and a first path length of a LOG-type signal line group through which the first gate low voltage is supplied to the first block larger than a second path length of a LOG-type signal line group through which the second gate low voltage is supplied to the second block.

DETAILED DESCRIPTION OF THE PREFERRED EMBODIMENT

Figure 1:
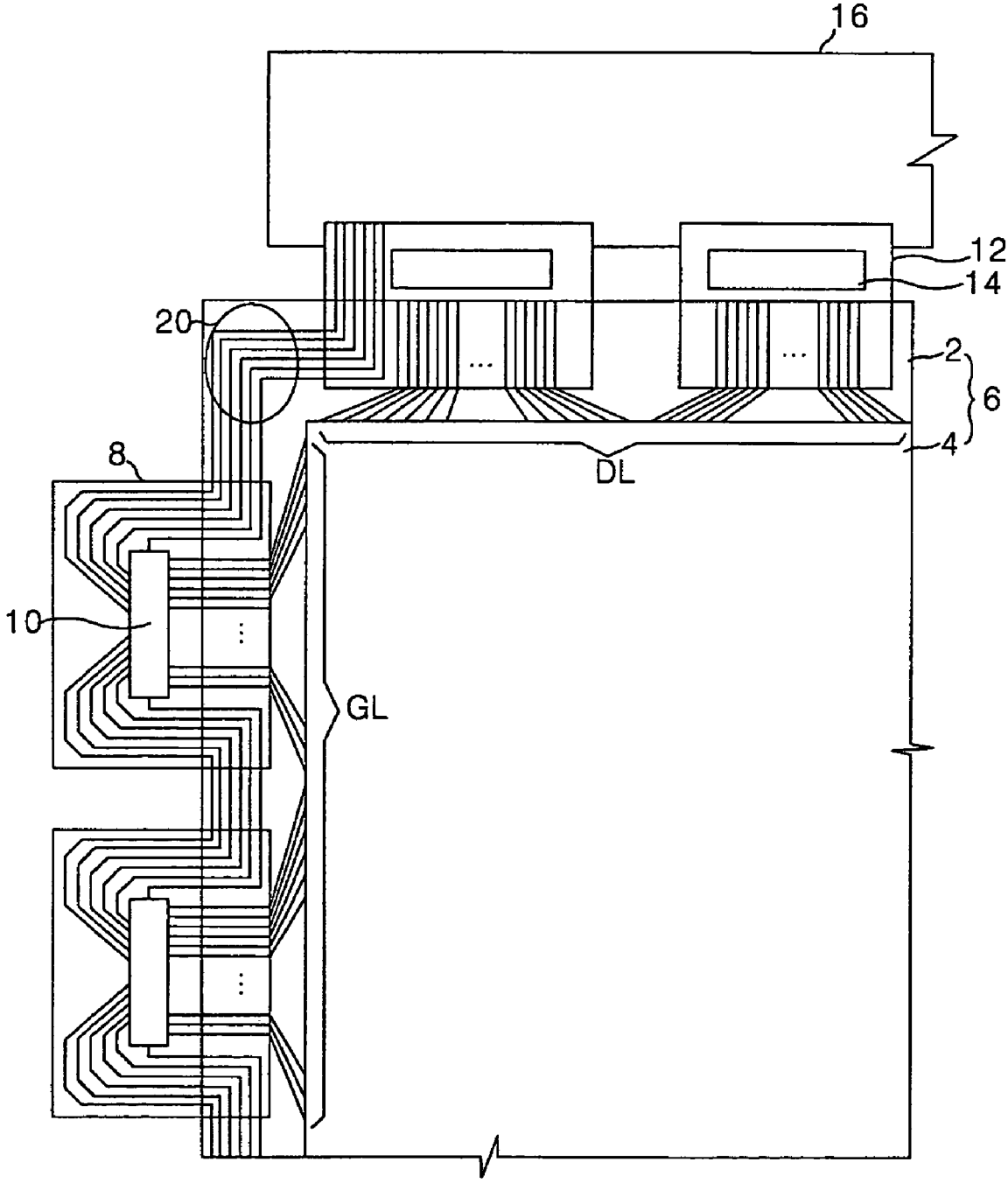
FIG. 1 RELATED ART
FIG. 1 is a schematic plan view showing a configuration of a conventional line on glass (LOG) type liquid crystal display.
Figure 2:
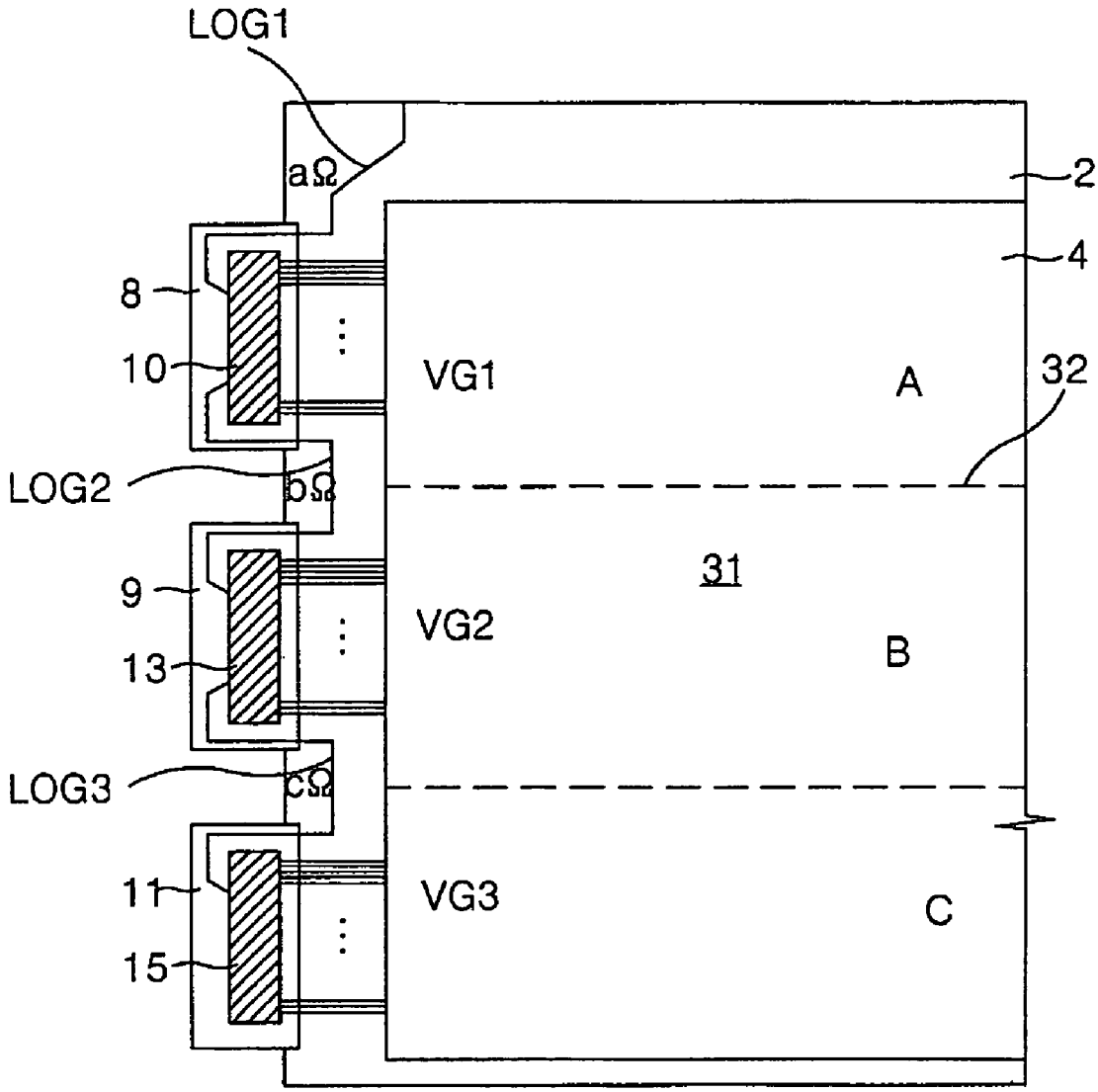
FIG. 2 RELATED ART
FIG. 2 is a view for explaining a horizontal line phenomenon in the liquid crystal display panel shown in FIG. 1.
Figure 3:
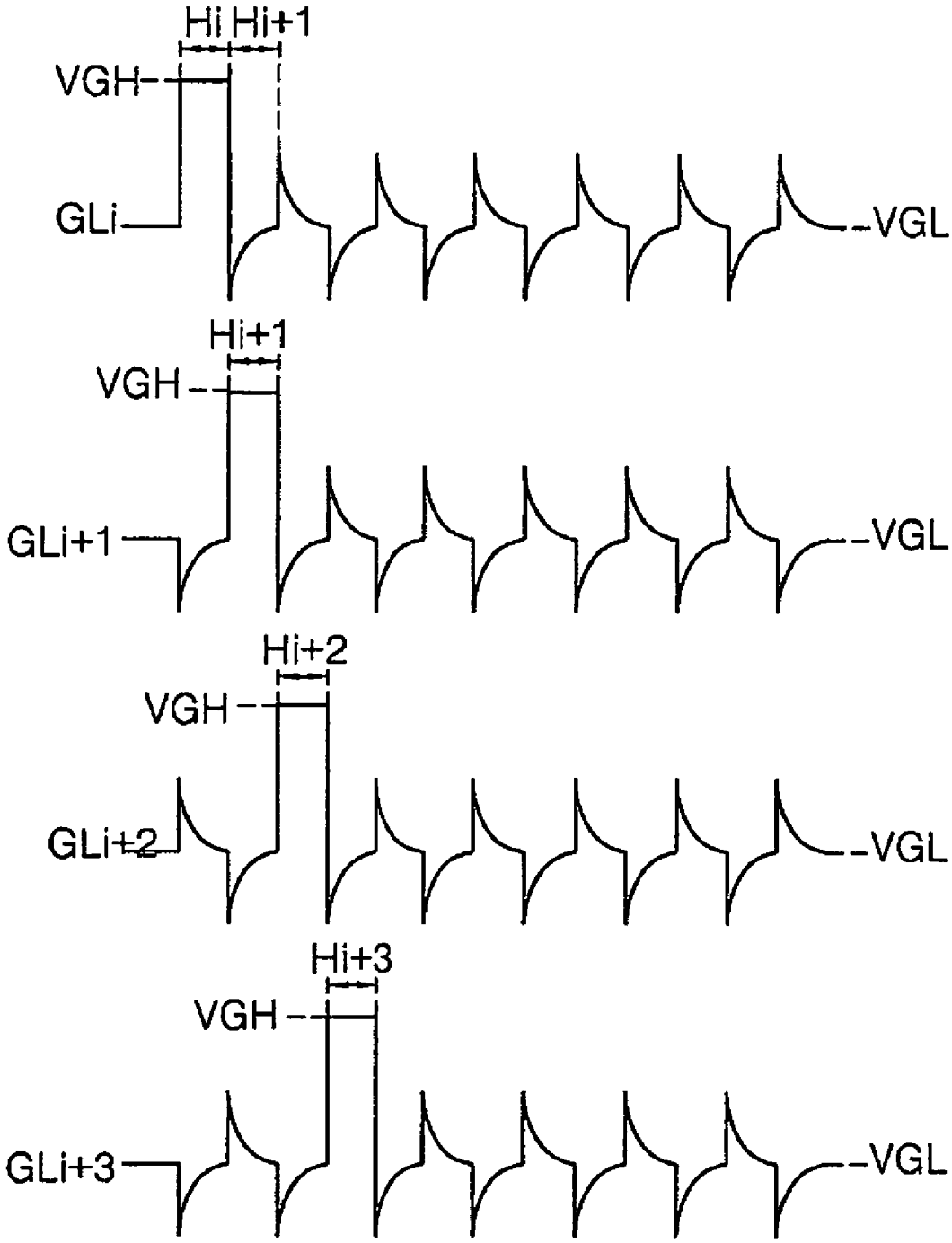
FIG.3 RELATED ART
FIG. 3 is a waveform diagram of a gate signal applied to a certain gate line shown in FIG. 1.
Figure 4:
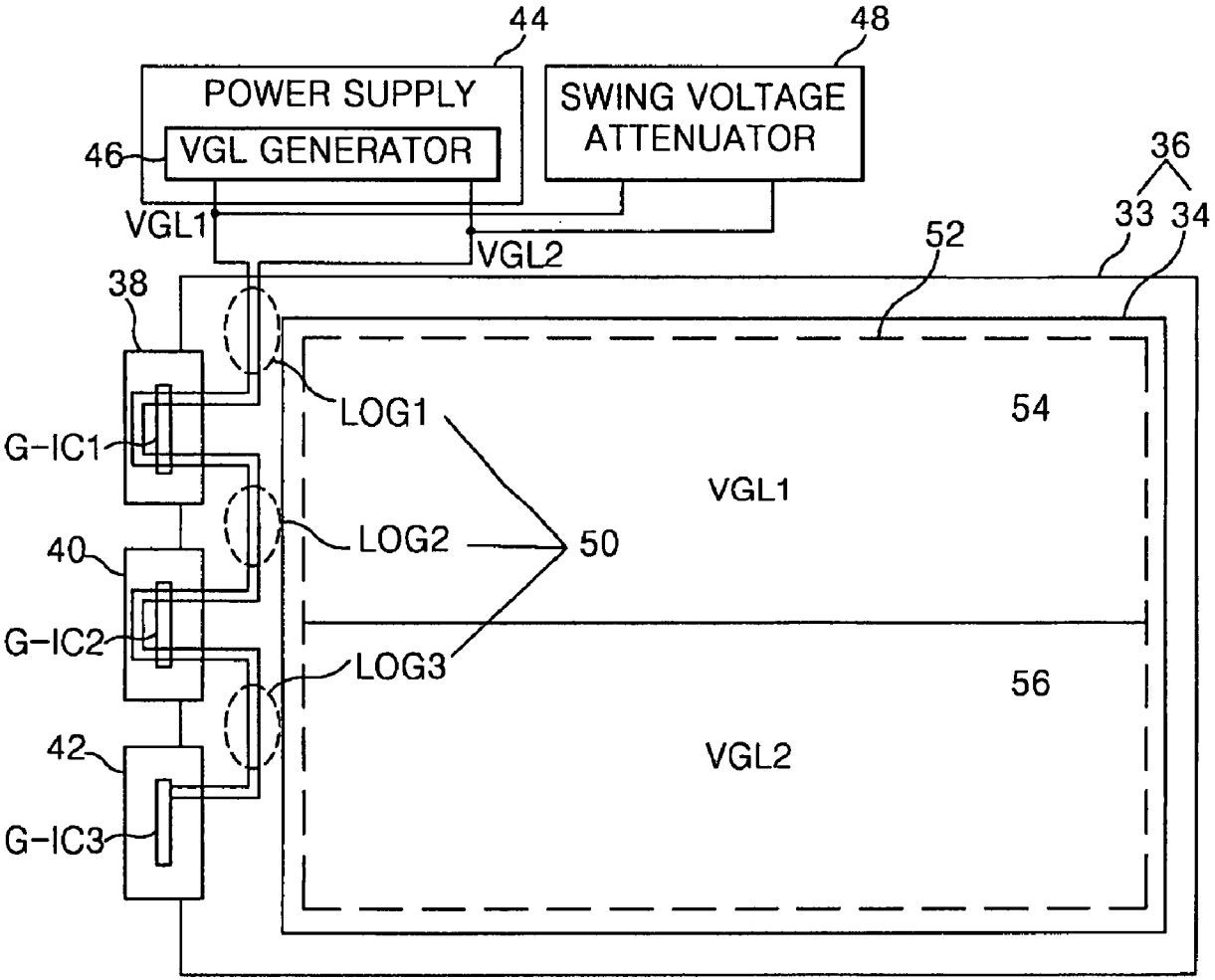
FIG. 4 is a schematic block diagram showing a configuration of a liquid crystal display device according to an embodiment of the present invention.

FIG. 4 schematically shows a gate driving apparatus for a liquid crystal display panel according to a first embodiment of the present invention.

Referring to FIG. 4, the gate driving apparatus for the liquid crystal display panel includes first to third gate drive IC's G-IC1 to G-IC3 connected, via first to third TCP's 38, 40 and 42, respectively, to gate lines of a liquid crystal display panel 36, a power supply 44 for generating and supplying gate power signals including first and second gate low voltages VGL1 and VGL2, and a timing controller (not shown) for generating and supplying gate control signals.

In the liquid crystal display panel 36, a thin film transistor array substrate 33 and a color filter array substrate 34 are joined to each other and have a liquid crystal therebetween. Such a liquid crystal display panel 36 includes liquid crystal cells defined at intersections between gate lines GL and data lines DL, each of which has a thin film transistor as a switching device. The thin film transistor applies a pixel signals from the data line to the liquid crystal cell in response to a scanning signal from the gate line.

The power supply 44 generates and supplies a gate high voltage VGH, a ground voltage GND and a base driving voltage VCC to be used at the gate drive IC's G-IC1 to G-IC3. Further, the power supply 44 generates a gate low voltage VGL via a gate low voltage generator 46, and supplies it via first and second output lines connected, in parallel, to the output terminal of the gate low voltage generator 46 as the first and second gate low voltages VGL1 and VGL2. Furthermore, the power supply 44 generates and supplies a common voltage VCOM to be applied, via the thin film transistor array substrate 33 of the liquid crystal display panel 36, to the color filter array substrate 34.

The first to third gate drive IC's G-IC1 to G-IC3 are connected, via first to third gate TCP's 38, 40 and 42, respectively, to the gate lines of the liquid crystal display panel 36. The first to third gate drive IC's G-IC1 to G-IC3 are supplied with gate control signals from the timing controller (not shown) and power signals from the power supply 44 via a LOG-type signal line group 50 and the TCP's 38, 40 and 42.

Figure 5:
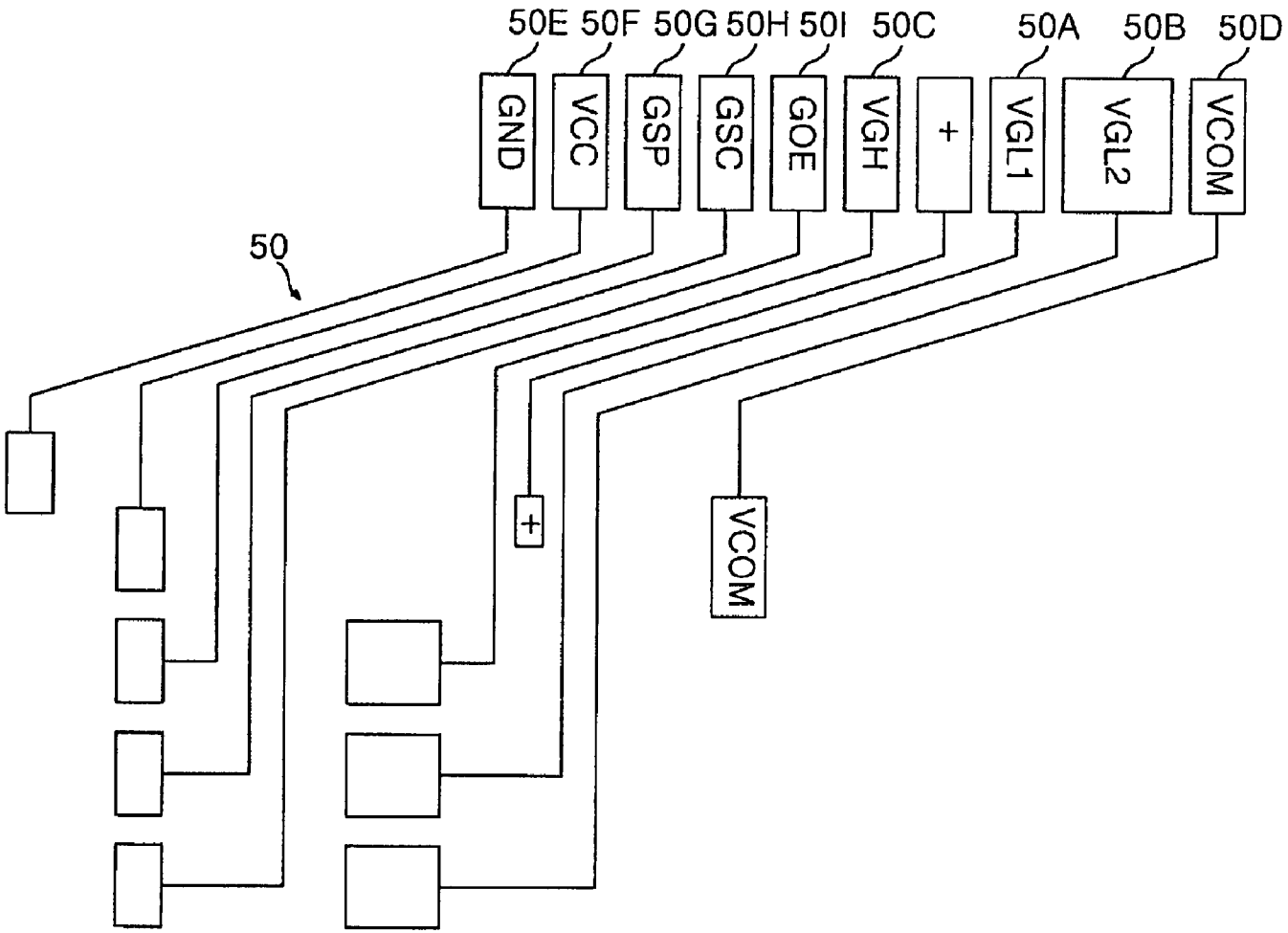
FIG. 5 is a detailed configuration view of the LOG-type signal line group shown in FIG. 4.

The first LOG-type signal line group LOG1 connected to the input terminal of the first TCP 38 is typically comprised of signal lines for supplying direct current driving voltages from the power supply 44, such as first and second gate low voltages VGL1 and VGL2, a gate high voltage VGH, a common voltage VCOM, a ground voltage GND and a base driving voltage VCC, and gate control signals from the timing controller, such as a gate start pulse GSP, a gate shift clock signal GSC and a gate enable signal GOE as shown in FIG. 5. A configuration of the second LOG-type signal line group LOG2 connected between the first and second TCP's 38 and 40 is as shown in FIG. 5, and the third LOG-type signal line group LOG3 connected between the second and third gate TCP's 40 and 42 is the remaining configuration excluding a line supplying the first gate low voltage VGL1 from FIG. 5.

A gate driver including the first to third gate drive IC's G-IC1 to G-IC3 supplies the gate high voltage VGH to each gate line of a picture display part 52 using a turn-on voltage of the thin film transistor in the corresponding scan period. Further, the gate driver divides the picture display part 52 into two portions, that is, the upper and lower blocks 54 and 56, and applies the first gate low voltage VGL1 to the gate lines at the upper block 54 and the second gate low voltage VGL2 to the gate lines at the lower block 56 by a turn-off voltage of the thin film transistor.

Thus, the gate lines driven by the first gate drive IC GIC-1 are supplied with the first gate low voltage VGL1, and the gate lines driven by the third gate drive IC G-IC3 are supplied with the second gate low voltage VGL2. The gate lines driven by the second gate drive IC G-IC2 are divided into two portions of upper and lower sides, and the upper gate lines are supplied with the first gate low voltage VGL1 while the lower gate lines is supplied with the second gate low voltage VGL2.

Figure 6:
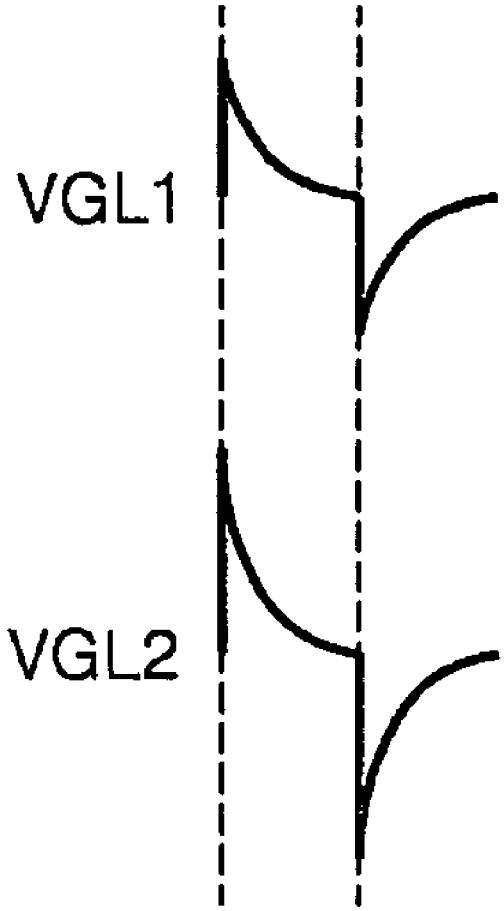
FIG. 6 is a waveform diagram of the first and second gate low voltages shown in FIG. 4.

As described above, in the embodiment of the present invention, the gate low voltage VGL is separated into the first gate low voltage VGL1 applied to an upper picture display part 54 and the second gate low voltage VGL2 applied to a lower display part 56. Thus, a load amount applied to each of the first and second gate low voltages VGL1 and VGL2, that is, a capacitance value of the parasitic capacitor between the gate line and the data line and an LOG resistance value are reduced. Accordingly, swing widths of the first and second gate low voltages VGL1 and VGL2 caused by the pixel signal applied to the data line are reduced, but a swing caused by the pixel signal still occurs as shown in FIG. 6.

Herein, a path (LOG1+LOG2) of the LOG-type signal line group through which the first gate low voltage VGL1 is applied becomes larger than a path (LOG1+LOG2+LOG3) of the LOG-type signal line group through which the second gate low voltage VGL2 is applied. Thus, a load amount applied to the second gate low voltage VGL 2 is larger than a load amount applied to the first gate low voltage VGL1, so that a swing width of the second gate low voltage VGL 2 becomes larger than that of the first gate low voltage VGL1.

Accordingly, the swing voltage attenuator 48 inverts and amplifies the first gate low voltage VGL1 fed back from the liquid crystal display panel and mixes it with the second gate low voltage VGL2, thereby allowing the swing voltages of the first and second gate low voltages VGL1 and VGL2 to be cancelled out with respect to each other. As a result, even though the parasitic capacitor and the LOG resistor are included in paths of the first gate low voltages VGL1 and VGL2, the first and second gate low voltages VGL1 and VGL2 can be stably applied to the gate lines of the picture display part 52. The storage capacitor having a storage on gate structure included in the liquid crystal cells of the picture display part 52 can charge a stable storage voltage. As a result, the storage capacitor minimizes a pixel voltage variation by an application of the stable storage voltage, thereby minimizing deterioration in the picture quality such as the greenish tinge and horizontal cross talk, etc.

Figure 7:
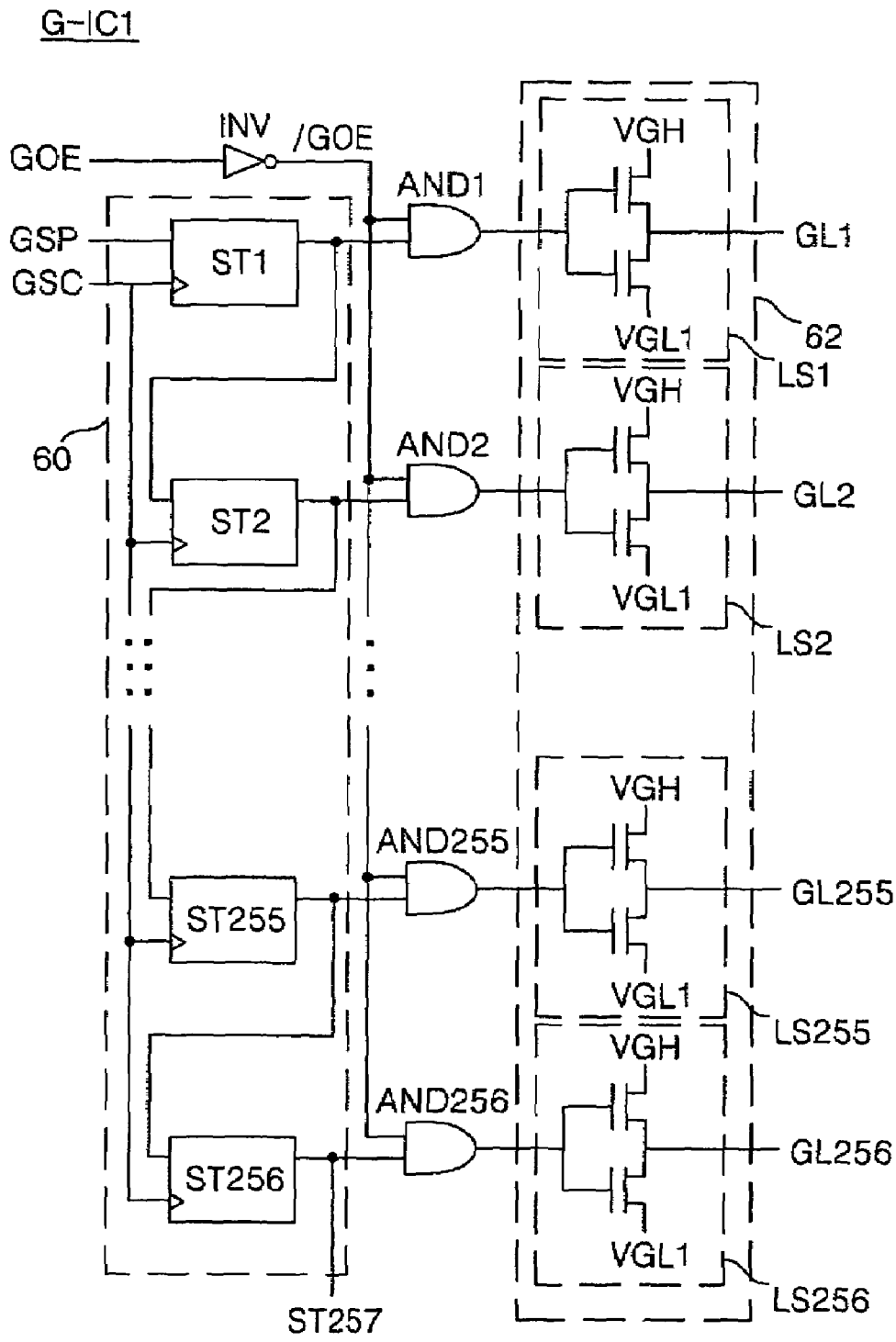
FIG. 7 is a detailed circuit diagram of the first gate drive IC shown in FIG. 4.

FIG. 7 shows a detailed circuit configuration of the first gate drive IC G-IC1 shown in FIG. 4.

Referring to FIG. 7, the first gate drive IC G-IC1 drives 1st to 256th gate lines GL1 to GL256. To this end, the first gate drive IC G-IC1 includes a shift register 60 and a first level shifter array 62.

The shift register 60 is connected to a gate start pulse (GSP) input line in cascade, and includes 1st to 256th stages ST1 to ST256 for commonly inputting a gate shift clock signal GSC. The 1st to 256th stages ST1 to ST256 sequentially shifts a gate start pulse GSP in response to the gate shift clock signal GSC and outputs it.

The 1st to 256th AND gates AND1 to AND256 make a logical product operation of output signals of the 1st to 256th stages ST1 to ST256 with a gate output enable signal/GOE inverted by an inverter INV, respectively, and applies them to the level shifter array 62. Each of the 1st to 256th AND gates AND1 to AND256 applies an output signal having a high state only when both each of the output signals of the shift register 60 and the inverted gate output enable signal/GOE have a high state to the level shifter array 62.

The level shifter array 62 includes 1st to 256th level shifters LS1 to LS256 connected between the 1st to 256th AND gates AND1 to AND256 and the 1st to 256th gate lines GL1 to GL256, respectively. Each of the 1st to 256th level shifters LS1 to LS256 selects the gate high voltage VGH when the corresponding input signal has a high state while selecting the first gate low voltage VGL1 when the corresponding input signal has a low state, to thereby apply it to each of the 1st to 256th gate lines GL1 to GL256.

Figure 8:
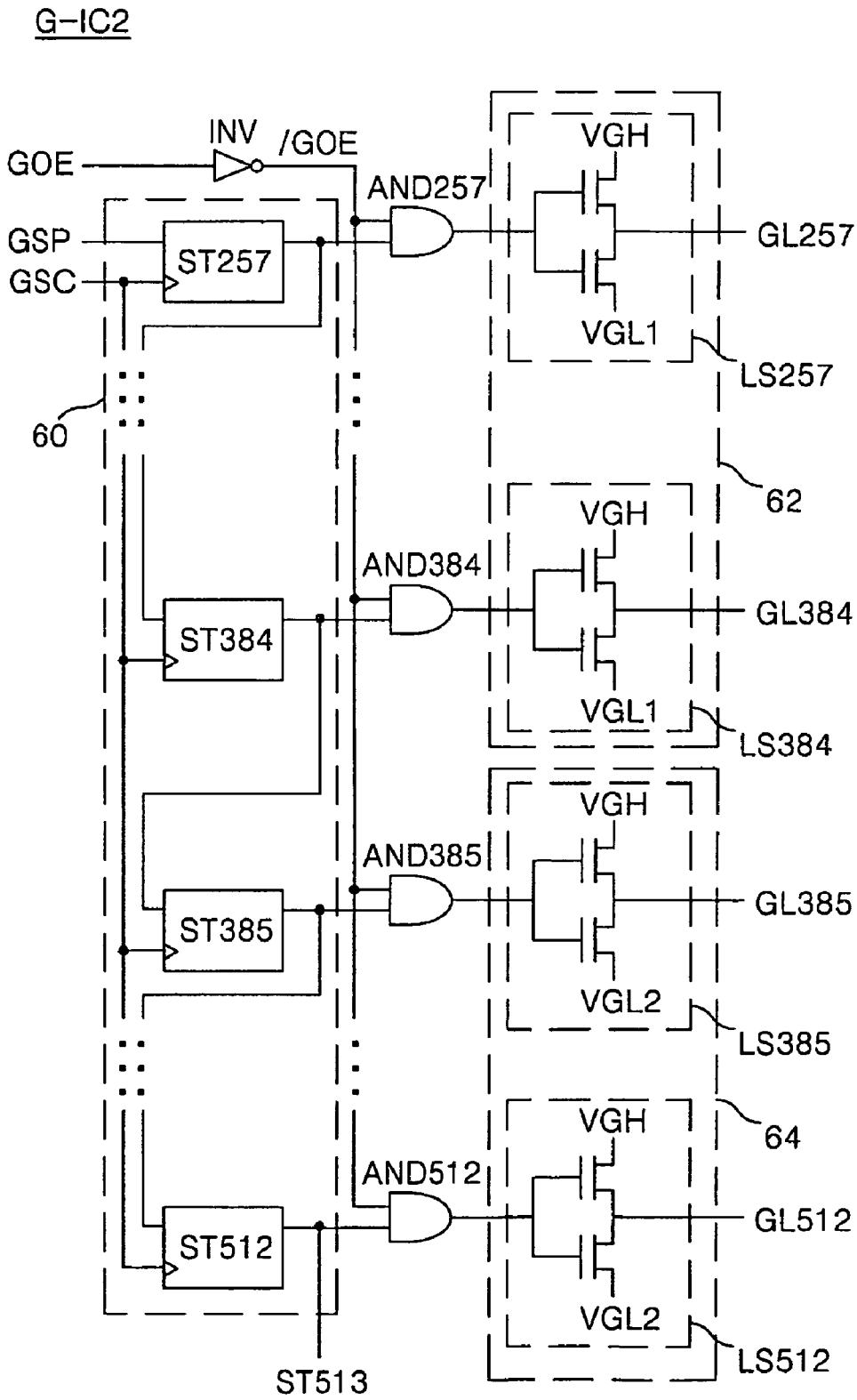
FIG. 8 is a detailed circuit diagram of the second gate drive IC shown in FIG. 4.

FIG. 8 shows a detailed circuit configuration of the second gate drive IC G-IC2 shown in FIG. 4.

Referring to FIG. 8, the second gate drive IC G-IC2 drives 257th to 512th gate lines GL257 to GL512. To this end, the second gate drive IC G-IC2 includes a shift register 60 and first level shifter arrays 62 and 64.

The shift register 60 is connected to an output line of the 256th stage ST256 shown in FIG. 7 in cascade, and includes 257th to 512th stages ST257 to ST526 for commonly inputting a gate shift clock signal GSC. The 257th to 512th stages ST257 to ST512 sequentially shifts the output signal of the 256th stage ST256 in response to the gate shift clock signal GSC and outputs it.

The 257th to 512th AND gates AND257 to AND512 make a logical product operation of output signals of the 256th to 512th stages ST257 to ST512 with a gate output enable signal/GOE inverted by an inverter INV, respectively, and applies them to the first and second level shifter arrays 62 and 64. Each of the 257th to 512th AND gates AND257 to AND512 applies an output signal having a high state only when both each of the output signals of the shift register 60 and the inverted gate output enable signal/GOE have a high state to the first and second level shifter arrays 62 and 64.

The first level shifter array 62 includes 257th to 384th level shifters LS257 to LS384 connected between the 257th to 384th AND gates AND257 to AND384 and the 257th to 384th gate lines GL257 to GL384, respectively. Each of the 257th to 384th level shifters LS257 to LS384 selects the gate high voltage VGH when the corresponding input signal has a high state while selecting the first gate low voltage VGL1 when the corresponding input signal has a low state, to thereby apply it to each of the 257th to 384th gate lines GL257 to GL384.

The second level shifter array 64 includes 385th to 512th level shifters LS385 to LS512 connected between the 385th to 512th AND gates AND385 to AND512 and the 385th to 512th gate lines GL385 to GL512, respectively. Each of the 385th to 512th level shifters LS385 to LS512 selects the gate high voltage VGH when the corresponding input signal has a high state while selecting the second gate low voltage VGL2 when the corresponding input signal has a low state, to thereby apply it to each of the 385th to 512th gate lines GL385 to GL512.

Figure 9:
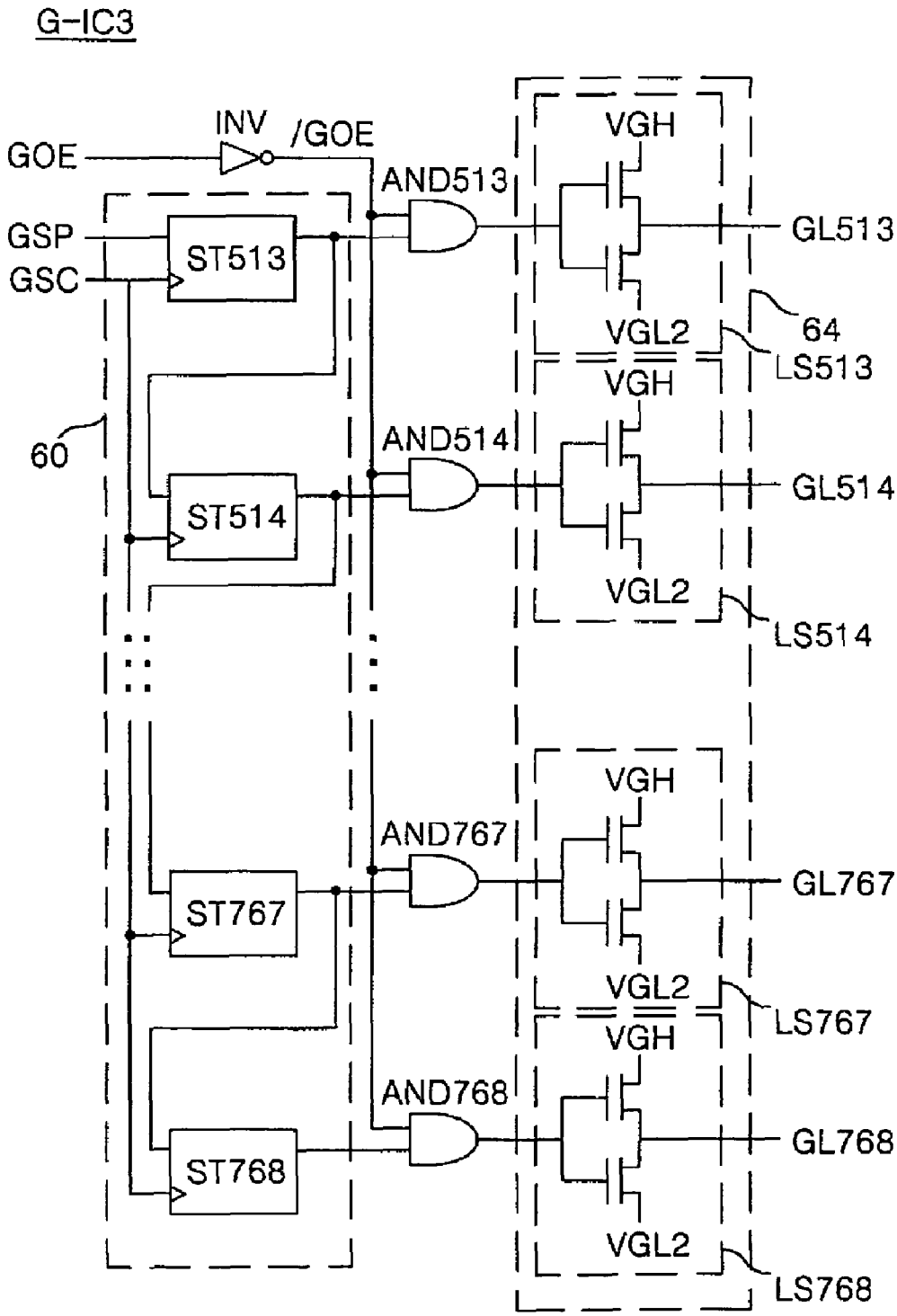
FIG. 9 is a detailed circuit diagram of the third gate drive IC shown in FIG. 4.

FIG. 9 shows a detailed circuit configuration of the third gate drive IC G-IC3 shown in FIG. 4.

Referring to FIG. 9, the third gate drive IC G-IC3 drives 513th to 768th gate lines GL513 to GL768. To this end, the third gate drive IC G-IC3 includes a shift register 60 and a second level shifter array 64.

The shift register 60 is connected to an output line of the 512th stage ST512 shown in FIG. 8 in cascade, and includes 513th to 768th stages ST513 to ST768 for commonly inputting a gate shift clock signal GSC. The 513th to 768th stages ST513 to ST768 sequentially shifts the output signal of the 512th stage ST512 in response to the gate shift clock signal GSC and outputs it.

The 513th to 768th AND gates AND513 to AND768 make a logical product operation of output signals of the 513th to 768th stages ST513 to ST768 with a gate output enable signal/GOE inverted by an inverter INV, respectively, and applies them to the second level shifter array 64. Each of the 513th to 768th AND gates AND513 to AND768 applies an output signal having a high state only when both each of the output signals of the shift register 60 and the inverted gate output enable signal/GOE have a high state to the second level shifter array 64.

The second level shifter array 64 includes 513th to 768th level shifters LS513 to LS768 connected between the 513th to 768th AND gates AND513 to AND768 and the 513th to 768th gate lines GL513 to GL768, respectively. Each of the 513th to 768th level shifters LS513 to LS768 selects the gate high voltage VGH when the corresponding input signal has a high state while selecting the second gate low voltage VGL2 when the corresponding input signal has a low state, to thereby apply it to each of the 513th to 768th gate lines GL513 to GL768.

Figure 10:
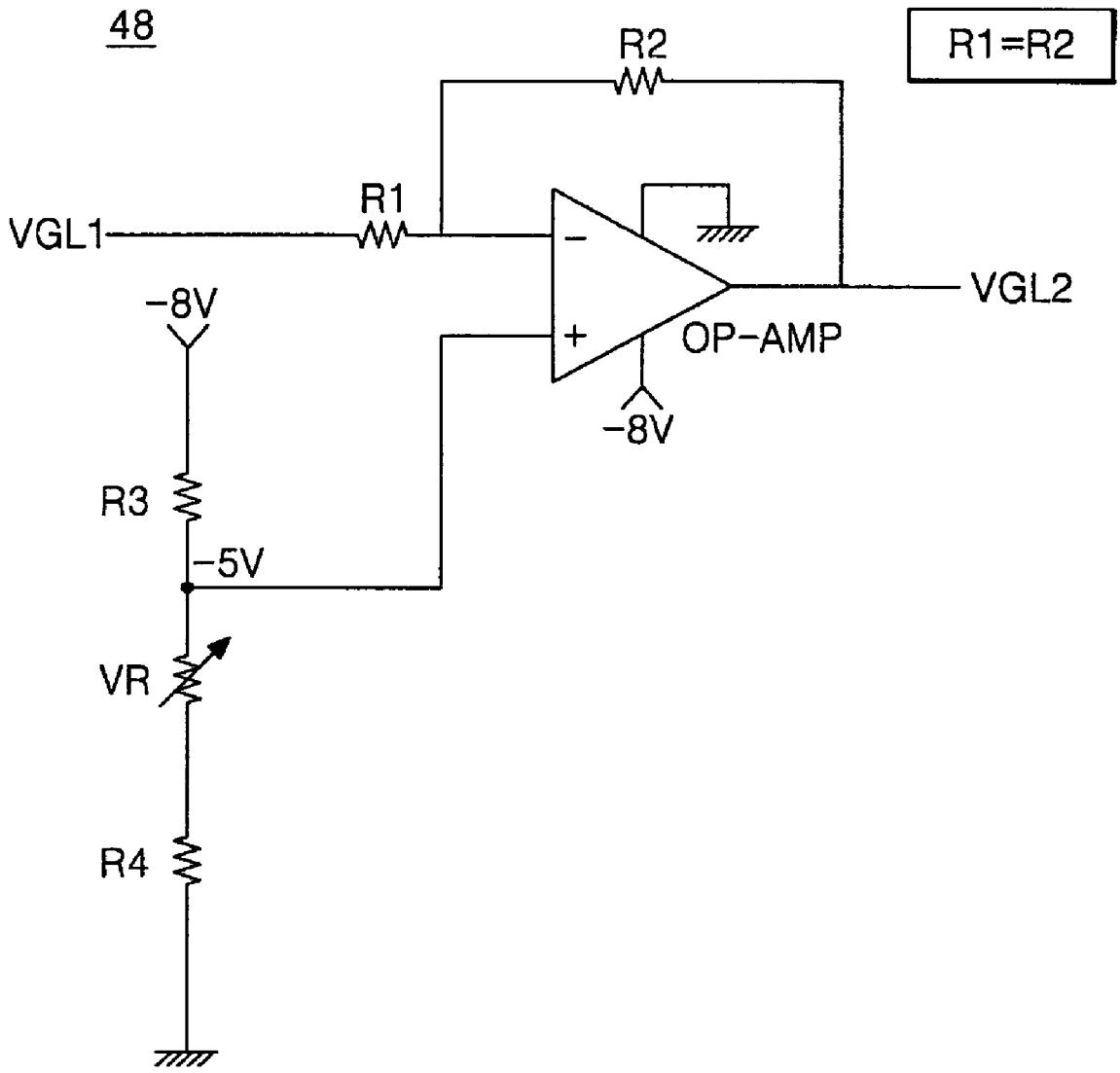
FIG. 10 is a detailed circuit diagram of the swing voltage attenuator shown in FIG. 4.

FIG. 10 shows a detailed circuit configuration of the swing voltage attenuator 48 shown in FIG. 4.

Referring to FIG. 10, the swing voltage attenuator 48 includes an inversion amplifier OP-AMP for inverting and amplifying a fed-back first gate low voltage VGL1 to sum it with a fed-back second gate low voltage VGL2. The inversion amplifier OP-AMP inputs the first gate low voltage VGL1, via a first resistor R1, to an inverting terminal thereof and inputs a reference voltage (−5V) to a non-inverting terminal thereof, thereby inverting and amplifying the first gate low voltage VGL1 and outputting it. The inverted and amplified signal of the first gate low voltage VGL1 outputted from the inversion amplifier OP-AMP is subject to summing with the second gate low voltage VGL2, thereby canceling out swing voltages of the first and second gate low voltages VGL1 and VGL2 with respect to each other. Thus, the first and second gate low voltages VGL1 and VGL2 are stabilized. Herein, the reference voltage (−5V) is generated at a voltage-division node between a third resistor R3 and a variable resistor VR with the aid of the third resistor R3, the variable resistor VR and a fourth resistor R4 that are connected, in series, between a first supply voltage (−8V) and a second supply voltage GND. Further, the first resistor R1 connected to the non-inverting input terminal of the inversion amplifier OP-AMP has the same resistance value as the second resistor R2 connected to the non-inverting input terminal and the output terminal thereof.

As described above, according to the present invention, the first and second gate low voltages are applied independently to the gate lines at the upper block and the gate lines at the lower block, respectively. Furthermore, according to the present invention, the fed-back first gate low voltage is inverted and amplified to sum it with the fed-back second gate low voltage, thereby canceling out swing voltages of the first and second gate low voltage with respect to each other thereby stabilizing application of the voltages. Accordingly, the storage capacitor charges and supplies a stable storage voltage to minimize a pixel voltage variation in the liquid crystal cell, thereby minimizing deterioration of the picture quality caused by a horizontal line, a greenish tinge and horizontal cross talk, etc. while adopting the LOG-type signal line.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display panel comprising:

a liquid crystal cell matrix defined by intersections between gate lines and data lines, the gate lines divided into a plurality of blocks;

thin film transistors connected at the intersections, each thin film transistor having a turn-on voltage and a turn-off voltage;

a gate driver for applying to the gate lines a gate high voltage in a particular time period and for applying to the gate lines independent gate low voltages for each block, the gate high voltage equaling or exceeding the turn-on voltage and the gate low voltages equaling or less than the turn-off voltage; and a power source generating the gate high voltage and a plurality of gate low voltages and applying them to the gate driver, wherein the gate driver applies the plurality of gate low voltages to the plurality of blocks, respectively.

2. The liquid crystal display panel according to claim 1, wherein the liquid crystal cell matrix is divided into an upper block and a lower block, and the gate driver applies a first gate low voltage to the gate lines of the upper block and a second gate low voltage to the gate lines of the lower block.

3. The liquid crystal display panel according to claim 2, further comprising:

a swing voltage attenuator for inverting and amplifying the first gate low voltage fed-back through the gate driver and summing the inverted and amplified first gate low voltage with the second gate low voltage fed-back through the gate driver, thereby canceling out swing voltages of the first and second gate low voltages with respect to each other.

4. The liquid crystal display panel according to claim 2, wherein the power source generates the fist and second gate low voltages and applies to the gate driver via first and second transmission lines in parallel, respectively.

5. The liquid crystal display panel according to claim 4, wherein the first and second gate low voltages are set to the same level.

6. The liquid crystal display panel according to claim 2, wherein the first and second gate low voltages are applied, via different line on glass (LOG) type signal lines provided at the liquid crystal display panel, to the gate driver.

7. The liquid crystal display panel according to claim 2, wherein each of the liquid crystal cells includes:

a storage capacitor provided at an overlapping portion between a pixel electrode included therein and a pre-stage gate line.

8. A gate driving method for a liquid crystal display panel including a liquid crystal cell matrix defined by intersections between gate lines divided into a plurality of blocks and data lines, and thin film transistors at the intersections, the method comprising:

applying a gate high voltage, which is a turn-on voltage of the thin film transistors, to the gate lines in a time period;

applying, to the gate lines, independent gate low voltages for each block, the gate low voltages being equal or lower than the turn-off voltages of the thin film transistors such that the thin film transistors are off when the gate low voltages are applied;

generating the gate high voltage; and generating a plurality of gate low voltages to be supplied to the plurality of blocks, respectively.

9. The gate driving method according to claim 8, further comprising dividing the liquid crystal cell matrix into an upper block and a lower block, and applying a first gate low voltage to the gate lines in the upper block and a second gate low voltage to the gate lines in the lower block.

10. The gate driving method according to claim 9, further comprising:

inverting and amplifying the first gate low voltage fed-back from the liquid crystal display panel; and summing the inverted and amplified first gate low voltage with the second gate low voltage fed-back from the liquid crystal display panel, thereby canceling out swing voltages of the first and second gate low voltages with respect to each other.

11. The gate driving method according to claim 9, wherein the plurality of gate low voltages includes the first and second gate low voltages.

12. The gate driving method according to claim 11, further comprising setting the first and second gate low voltages to the same level.

13. The gate driving method according to claim 9, further comprising applying the first and second gate low voltages via different line on glass (LOG) type signal lines provided at the liquid crystal display panel.

14. A liquid crystal display panel comprising:

a substrate;

a liquid crystal cell matrix defined by intersections between gate lines and data lines disposed on the substrate, the gate lines divided into blocks;

thin film transistors disposed on the substrate and connected to the gate and data lines at the intersections;

a gate driver that supplies a gate high voltage to the gate lines throughout the matrix and that supplies a gate low voltage to the gate lines of each block that are independent of the gate low voltage supplied to the gate lines of other blocks, a transition between application of the gate high voltage to the gate lines in one block and application of the gate high voltage to the gate lines in another block occurring only once each time the gate high voltages are supplied in a scan throughout the matrix, each transistor being in a non-conducting state upon application of the gate low voltage and being in a conducting state upon application of the gate high voltage; and a power source generating the gate high voltage and a plurality of gate low voltages and applying them to the gate driver, wherein the gate driver applies the plurality of gate low voltages to the plurality of blocks, respectively.

15. The liquid crystal display panel according to claim 14, wherein the gate driver comprises a plurality of gate drive ICs that each drive a set of gate lines in one of the blocks, at least one of the gate drive ICs driving the gate lines of only one of the blocks and at least one of the gate drive ICs driving the gate lines of different blocks.

16. The liquid crystal display panel according to claim 15, wherein each gate drive IC comprises a shift register and level shifters array containing level shifters for each gate line connected with the gate drive IC.

17. The liquid crystal display panel according to claim 16, wherein half of the level shifters in the level shifter array of one of the gate drive ICs supply a first gate low voltage to the gate lines connected with the half of the level shifters and the other half of the level shifters supply a second gate low voltage that is independent of the first gate low voltage to the gate lines connected with the other half of the level shifters.

18. The liquid crystal display panel according to claim 17, wherein the level shifters in the gate drive IC that supply the first and second gate low voltages to the gate lines also supply the same gate high voltage to each of the gate lines connected with the gate drive IC that supplies the first and second gate low voltages.

19. The liquid crystal display panel according to claim 17, wherein the level shifters in the gate drive ICs other than the gate drive IC that supplies the first and second gate low voltages to the gate lines supply the same gate low voltage to each of the gate lines connected with the particular gate drive IC.

20. The liquid crystal display panel according to claim 19, wherein the gate low voltages supplied to all of the gate lines are the same.

21. The liquid crystal display panel according to claim 14, wherein the gate high voltages are sequentially supplied to the transistors throughout the matrix.

22. The liquid crystal display panel according to claim 14, further comprising a swing voltage attenuator through which one of the gate low voltages fed-back through the gate driver is inverted and amplified and then summed with another of the gate low voltages fed-back through the gate driver.

23. The liquid crystal display panel according to claim 14, wherein the different gate low voltages are supplied to the gate driver via different line on glass (LOG) type signal lines.

24. The liquid crystal display panel according to claim 23, wherein the different LOG type signal lines have substantially the same path length on the substrate.

25. The liquid crystal display panel according to claim 23, wherein a first of the blocks is supplied solely with a first gate low voltage, a second of the blocks is supplied solely with a second gate low voltage, and a first path length of a LOG-type signal line group through which the first gate low voltage is supplied to the first block is larger than a second path length of a LOG-type signal line group through which the second gate low voltage is supplied to the second block.

* * * * *

UNITED STATES PATENT AND TRADEMARK OFFICE

CERTIFICATE OF CORRECTION

PATENT NO. : 7,375,718 B2
APPLICATION NO. : 10/874615
DATED : May 20, 2008
INVENTOR(S) : Sang Rae Kim It is certified that error appears in the above-identified patent and that said Letters Patent is hereby corrected as shown below:

In column 10, claim 4, line 65, after "source generates the" delete "fist" and substitute --first-- in its place.

Signed and Sealed this

Seventeenth Day of March, 2009

JOHN DOLL
*Acting Director of the United States Patent and Trademark Office*